US009932798B1

(12) United States Patent
Resendez

(10) Patent No.: US 9,932,798 B1
(45) Date of Patent: Apr. 3, 2018

(54) HELIX NOZZLE OSCILLATING DELIVERY SYSTEM

(71) Applicant: Coil Solutions CA., Calgary (CA)

(72) Inventor: Esteban Resendez, Baton Rouge, LA (US)

(73) Assignee: Coil Solutions CA., Medicine Hat, Alberta (CA)

( * ) Notice: Subject to any disclaimer, the term of this patent is extended or adjusted under 35 U.S.C. 154(b) by 290 days.

(21) Appl. No.: 14/967,757

(22) Filed: Dec. 14, 2015

Related U.S. Application Data

(60) Provisional application No. 62/180,478, filed on Jun. 16, 2015.

(51) Int. Cl.
*E21B 37/00* (2006.01)

(52) U.S. Cl.
CPC ..... *E21B 37/00* (2013.01)

(58) Field of Classification Search
CPC ..... E21B 7/18; E21B 37/00; E21B 41/0078
See application file for complete search history.

(56) References Cited

U.S. PATENT DOCUMENTS

| | | | | |
|---|---|---|---|---|
| 137,881 | A | 4/1873 | Berryman et al. | |
| 5,228,508 | A | 7/1993 | Facteau et al. | |
| 5,495,903 | A | 3/1996 | Griffin et al. | |
| 6,029,746 | A | 2/2000 | Dodd | |
| 6,039,117 | A | 3/2000 | Mueller | |
| 6,062,311 | A | 5/2000 | Johnson et al. | |
| 6,397,864 | B1 | 6/2002 | Johnson | |
| 7,404,416 | B2 | 7/2008 | Schultz et al. | |
| 7,650,941 | B2 | 1/2010 | Zachry | |
| 7,913,763 | B2 | 3/2011 | D'Amico | |
| 8,316,944 | B2 | 11/2012 | Pringle et al. | |
| 8,424,620 | B2 * | 4/2013 | Perry, Jr. | E21B 7/061 175/62 |
| 8,936,094 | B2 * | 1/2015 | Least | E21B 34/06 166/205 |
| 2006/0086507 | A1 | 4/2006 | Surjaatmadja et al. | |
| 2010/0270081 | A1 * | 10/2010 | Perry, Jr. | E21B 7/18 175/62 |
| 2013/0213716 | A1 * | 8/2013 | Perry | E21B 7/046 175/62 |

* cited by examiner

*Primary Examiner* — Shane Bomar
(74) *Attorney, Agent, or Firm* — Ramey & Schwaller, LLP

(57) ABSTRACT

A helix nozzle oscillating tool that creates a fluid pattern with both spinning and acoustic/oscillating methods. The tool has no moving parts and its function is not limited by pressures, temperatures, volumes of fluid or fluid type. The tool more efficiently cleans out scale and debris build-up from a productive or formerly productive well, perforations and near region surrounding the well. The tool can be used in a variety of wells, including, but not limited to oil, gas, and wastewater wells.

13 Claims, 2 Drawing Sheets

HELIX NOZZLE OSCILLATING DELIVERY SYSTEM

CROSS-REFERENCE TO RELATED APPLICATIONS

The present application claims priority to U.S. Provisional Patent Application Ser. No. 62/180,478 for Helix Nozzle Oscillating Delivery System which was filed on Jun. 16, 2015.

BACKGROUND OF THE INVENTION

1. Field of the Invention

The present invention relates to oil, gas, water and wastewater well remediation. More particularly, the invention is a tool directed to cleaning out scale and debris buildup from productive or formerly productive oil, gas or wastewater wells, including perforations and near region that surrounds the well. The present invention may be used on a coiled tubing drilling rig.

2. Description of the Related Art

In conducting service and work over on a well, a nozzle is used on the end of the tubing string of pipe of a drilling rig or coil tubing to deliver fluid to the inside of the well. Current nozzle flow patterns, which consist of static flow, cavitation, acoustic/oscillation, and spinning nozzles, are limited to pressures, temperatures, fluid type and volumes. Current technologies can only create one type of fluid pattern, which limits the functionality when cleaning out wells. Some nozzles have moving parts to create such patterns during operations. Moving parts increase the need for repair and maintenance of the nozzles.

There is a need for a better nozzle that produces a more effective flow pattern and does this without the need for moving parts. The present invention addresses this need.

One objective of the present invention is to create a nozzle that produces a fluid pattern with both spinning and acoustic/oscillating flow with the nozzle having no moving parts and without being limited to pressures, temperatures, volumes or fluid type. The present invention can produce an oscillating and fluid torqued spinning action, accelerated through a Venturi effect, as the fluid or gases that are flowing through the nozzle exit the nozzle ports.

Another objective of the present invention is that it more effectively and more efficiently removes scale and debris build-up from a well, from perforations, and from near regions surrounding the well.

SUMMARY OF THE INVENTION

The invention is a nozzle tool that produces a helical oscillating flow within a productive or formerly productive oil, gas, water or wastewater well as a means of cleaning the well of scale and debris buildup. The nozzle tool attaches on an upper end to a tubing string pipe or coil tubing and fluid is directed from the tubing string pipe into and through the nozzle tool. The nozzle tool is provided internally with an initial compression and then expansion chamber and then the fluid separates into two flow paths. Each of the two flow paths is first compressed, then expanded, then simultaneously compressed and rifled to create helical flow before once again being expanded into a multi-port oriented nozzle. The multi-port oriented nozzle is provided with ports from which the now spinning and pulsing fluid exits as jets of fluid. The ports are at orientations that allow the jetting fluid to impact the surrounding well to best effect.

DETAILED DESCRIPTION OF THE PREFERRED EMBODIMENT

Figure 1:
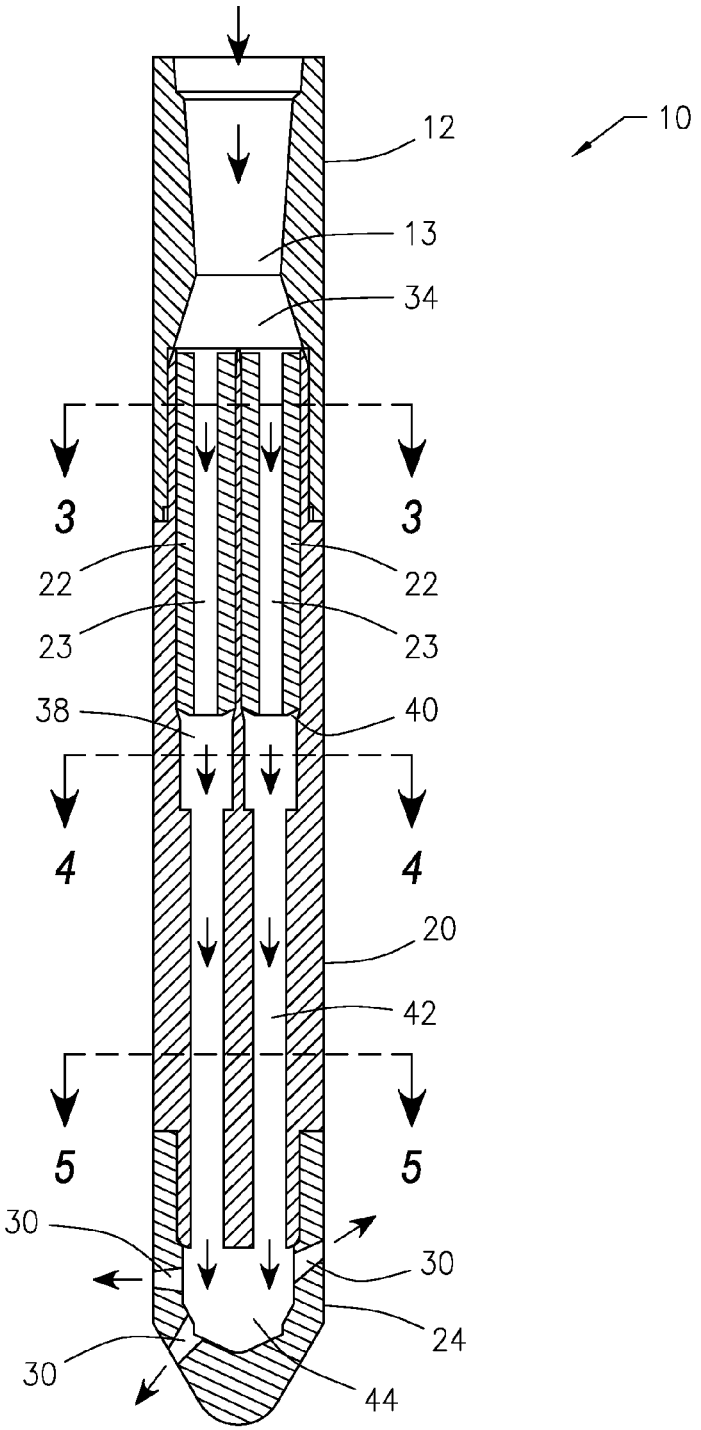
FIG. 1 is a cross sectional view of a nozzle that is constructed in accordance with a preferred embodiment of the present invention.

Referring now to the drawings and initially to FIG. 1, there is illustrated a nozzle tool 10 for producing a helical oscillating flow within a well. The nozzle tool 10 can be constructed of 4140 carbon steel, stainless steel, ceramic, titanium, silicon nitride or other suitable alloys. The nozzle tool 10 is designed to be attached to a well string (not shown) via a dual threaded connector 12 provided on the nozzle tool 10. The nozzle tool is constructed of five pieces: a dual threaded connector 12, two flow inserts 22, a main body 20, and a multi-port oriented nozzle 24.

Figure 2:
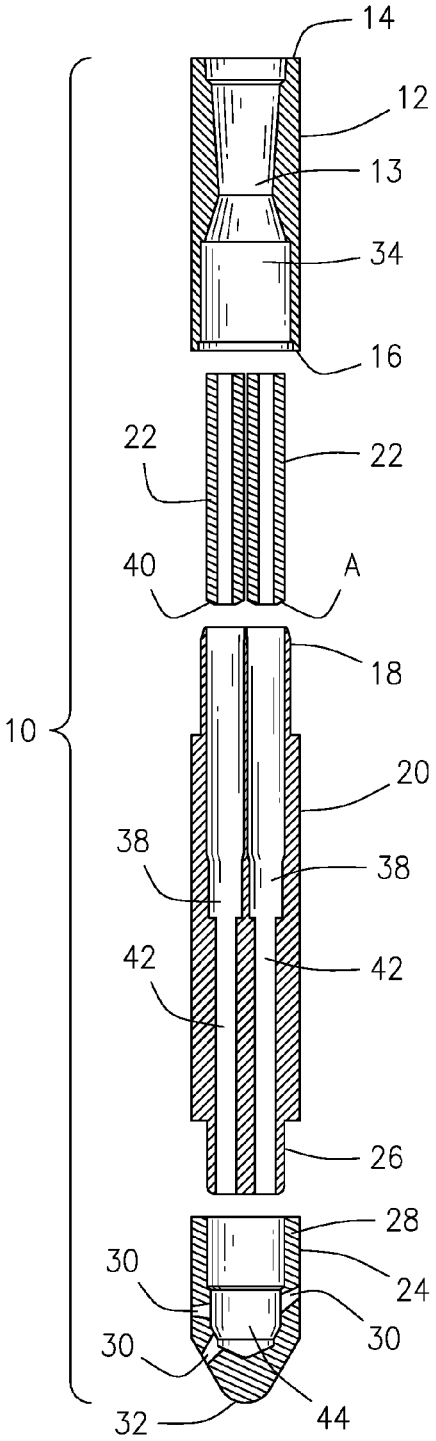
FIG. 2 is an exploded slightly enlarge view of the nozzle of FIG. 1.
Figure 3:
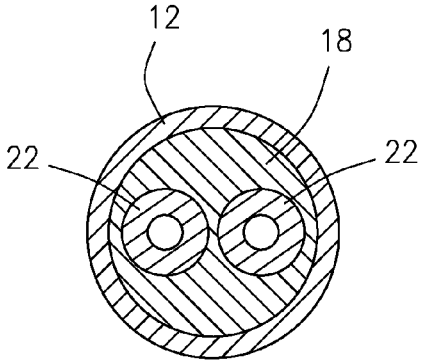
FIG. 3 is a slightly enlarged cross sectional view taken along line 3-3 of FIG. 1.

Referring also to FIG. 2, the nozzle tool 10 is constructed of the dual threaded connector 12 which attaches on its upper end 14 to a well string and which attaches on its opposite lower end 16 to a threaded upper end 18 of the main body 20 of the nozzle tool 10. Contained within the main body 20 of the nozzle tool 10 are the pair of dual flow inserts 22. As shown in FIG. 3, the dual flow inserts 22 split the flow path into two separate cylindrical paths.

The multi-port oriented nozzle 24 is attached to a threaded lower end 26 of the main body 20 of the nozzle tool 10 via a threaded upper end 28 provided on the multi-port oriented nozzle 24. The multi-port oriented nozzle 24 has a plurality of nozzle openings or ports 30 extending through its lower end 32. Fluid flowing through the nozzle tool 10 exits the multi-port oriented nozzle 24 via the nozzle ports 30.

The arrows in FIG. 1 show the flow path of fluid through the nozzle tool 10 when the nozzle tool 10 is in service attached to the end of a well string. Fluid enters the nozzle tool 10 from the well string via a fluid entry and expansion chamber 34 provided within the dual threaded connector 12. The fluid entering the dual threaded connector 12 is initially squeezed or compressed by a somewhat constricted area 13 at the upper end 14 of the connector 12 and then allowed to expand as it enters the chamber 34.

Figure 4:
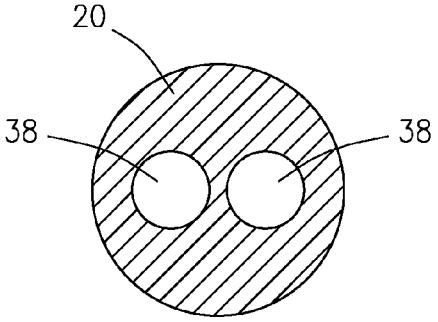
FIG. 4 is a slightly enlarged cross sectional view taken along line 4-4 of FIG. 1.

Fluid flows out of the fluid entry and expansion chamber 34 into one of two flow paths created by dual flow inserts 22 contained within the main body 22 of the nozzle tool 10. As the fluid flows into the dual flow inserts, it is once again squeezed or compressed. Fluid flows through the dual flow inserts 22 in dual flow paths 23 and exits the dual flow inserts 22 into a pair of second expansion chambers 38. Referring to FIG. 4, flow from the dual flow inserts 22 enters into separate second expansion chambers 38. The fluid once again expands as it enters the second expansion chambers 38.

As shown in FIG. 2, a discharge end 40 of each of the dual flow inserts 22 is tapered at approximately a 22-30 angle, and preferably at approximately a 26 degree angle A. The purpose of angle A is to reduce wear due to cavitation caused by the fluid that as it exiting the dual flow inserts 22.

Figure 5:
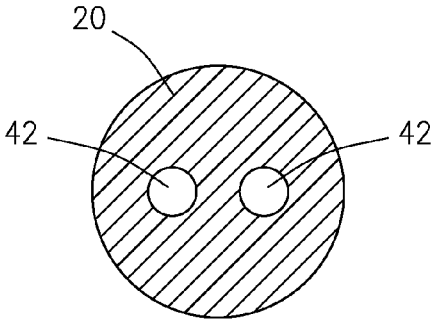
FIG. 5 is a slightly enlarged cross sectional view taken along line 5-5 of FIG. 1.

Fluid flows through the second expansion chambers 38 and into separate dual rifled flow chambers 42 provided in the main body 20 of the nozzle tool 10. FIG. 5 shows the dual rifled flow chambers 42. Upon entering the dual rifled flow chambers 42, the fluid is once again squeezed or compressed. Fluid flows through the dual rifled flow chambers 42 and exits into a third expansion chamber 44 provided in the multi-port oriented nozzle 24 that is attached to the threaded lower end 26 of the main body 20.

From the third expansion chamber 44, fluid flows out of the nozzle tool 10 via multiple ports 30 provided in the multi-port oriented nozzle 24. There may be between 3-12 ports per nozzle 24. The diameter of each port 30 is preferably in the range of 0.09-0.1 inches so that the discharge from each port 30 forms a jet stream of fluid.

The ports 30 are oriented at an angle of between 25-27 degrees upward, at an angle of between 25-27 degrees downward, and at an angle of between 45 and 135 degrees sideward. However, the ports 30 are more preferably oriented at approximately 26 degrees upward, at approximately 26 degrees downward, and at approximately 90 degree sideward.

Any given nozzle tool 10 may have any combination of upward, downward and sideward orientation of ports 30, including nozzle tools 10 with only one type of port orientation, two types of port orientations, or all three types of port orientations.

However, the number of ports 30, the arrangement of the ports 30 in the multi-port oriented nozzle 24, the types of port orientations, and the angle of the ports 30 are variable and will be determined by the cleaning needs of a given well.

As the fluid flows through the dual rifled flow chambers 42, it takes on a spinning, spiral or helical flow pattern similar to the spinning motion created in a bullet as it passes through the barrel of a rifle. This helical flow pattern continues and is maintained in the fluid as it passes out of the nozzle tool via the ports 30.

According to Bernoulli's principle, the speed of flow of an incompressible fluid will increase with a decrease in pressure, and the speed of flow will decrease with an increase in pressure. Thus, as the fluid passes through the nozzle tool 10, it undergoes repeated expansion into chambers of lower pressure and compression into flow paths of higher pressure. This results in a varying speed of flow in the fluid stream.

The repeated expansion and compression that the fluid undergoes as it passes through the nozzle tool 10 creates an oscillating, pulsing, pounding, or cavitating motion to the fluid flow. This oscillation flow pattern continues and is maintained in the fluid as it passes out of the nozzle tool via the ports 30.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A helix nozzle oscillating delivery system for use in cleaning out scale and debris buildup from wells comprising:

a nozzle tool attachable via a threaded upper end to a tubing string pipe, said nozzle tool being provided with a hollow interior so that fluid received from the tubing string pipe flows through the nozzle tool, said nozzle tool being provided internally with two separate flow paths that are alternatingly constricted and expanded to cause the fluid flowing through the nozzle tool to pulsate, said two separate flow paths including rifled flow chambers to cause the fluid flowing through the nozzle tool to rotate in a helical flow pattern, and a plurality of ports extending through a wall of the nozzle tool on a lower end for delivering helically rotating and pulsating jets of fluid out of the nozzle tool.

2. A helix nozzle oscillating delivery system according to claim 1 further comprising:

said ports oriented upward, downward or sideward relative to the nozzle tool.

3. A helix nozzle oscillating delivery system according to claim 2 further comprising:

said ports oriented upward relative to the nozzle tool at angles of between 25-27 degrees upward, of between 25-27 degrees downward, or between 45 and 135 degrees sideward.

4. A helix nozzle oscillating delivery system according to claim 2 further comprising:

said ports oriented upward relative to the nozzle tool at an angle of 26 degrees upward, of 26 degrees downward, or of 90 degrees sideward.

5. A helix nozzle oscillating delivery system according to claim 1 further comprising:

said nozzle tool being provided internally with dual flow inserts for separating flow into the two separate flow paths.

6. A helix nozzle oscillating delivery system for use in cleaning out scale and debris buildup from wells comprising:

a nozzle tool attachable via an upper end to a tubing string pipe, said nozzle tool being provided with a hollow interior so that fluid received from the tubing string pipe flows through the nozzle tool, the nozzle tool provided within its hollow interior with a fluid entry and expansion chamber located adjacent to the upper end of the nozzle tool and in fluid communication with the open upper end of the nozzle tool for receiving fluid from the tubing string pipe and then compressing and expanding the fluid, dual flow inserts provided within the hollow interior of the nozzle tool adjacent to and in fluid communication with the fluid entry and expansion chamber for receiving fluid from the fluid entry and expansion chamber and then separating the fluid into two fluid flow streams and compressing the two fluid flow streams, a separate second expansion chamber provided within the hollow interior of the nozzle tool adjacent to and in fluid communication with each of the flow inserts for receiving and expanding the two fluid flow streams, a separate rifled flow chamber provided within the hollow interior of the nozzle tool adjacent to and in fluid communication with each of the second expansion chambers for receiving the two fluid flow streams and then compressing and causing a helical rotation in the two fluid flow streams, a common third expansion chamber provided within the hollow interior of the nozzle tool adjacent to and in fluid communication with the rifled flow chambers for receiving the two fluid flow streams and expanding and combining the fluid from the two fluid flow streams into a single helically rotating and pulsating stream, and a plurality of ports provided extending through a wall of the third expansion chamber for delivering fluid from within the third expansion chamber out of the nozzle tool as helically rotating and pulsating jet streams.

7. A helix nozzle oscillating delivery system according to claim 6 further comprising:

said ports oriented upward, downward or sideward relative to the nozzle tool.

8. A helix nozzle oscillating delivery system according to claim 7 further comprising:

said ports oriented upward relative to the nozzle tool at angles of between 25-27 degrees upward, of between 25-27 degrees downward, and between 45 and 135 degrees sideward.

9. A helix nozzle oscillating delivery system according to claim 7 further comprising:

said ports oriented upward relative to the nozzle tool at an angle of 26 degrees upward, of 26 degrees downward, and of 90 degrees sideward.

10. A method of delivering helically rotating and pulsating jet streams within a well to clean out scale and debris buildup from within the well comprising:

attaching a nozzle tool to a drill string pipe so that the nozzle tool receives fluid from the drill string pipe into an hollow interior of the nozzle tool, causing the fluid to flow through the hollow interior of the nozzle tool where the fluid is separated into two separate flow paths, is repeatedly compressed and expanded to creating a pulsing flow and is passed through rifled flow chambers to create a rotating helically flow, and causing the pulsing and helically rotating fluid to pass out of the nozzle tool through ports in the tool to create pulsing and helically rotating jets of fluid, said nozzle tool being provided internally with two separate flow paths that are alternatingly constricted and expanded to cause the fluid flowing through the nozzle tool to pulsate, said two separate flow paths including rifled flow chambers to cause the fluid flowing through the nozzle tool to rotate in a helical flow pattern, and a plurality of ports extending through a wall of the nozzle tool on a lower end for delivering helically rotating and pulsating jets of fluid out of the nozzle tool.

11. A method according to claim 10 further comprising:

orienting the ports upward, downward or sideward relative to the nozzle tool to direct the helically rotating and pulsating jets outward from the nozzle tool toward the walls of a well in which the nozzle tool is being used.

12. A method according to claim 11 further comprising:

orienting the ports relative to the nozzle tool at angles of between 25-27 degrees upward, of between 25-27 degrees downward, and between 45 and 135 degrees sideward.

13. A method according to claim 11 further comprising:

Orienting the ports relative to the nozzle tool at an angle of 26 degrees upward, of 26 degrees downward, or of 90 degrees sideward.

* * * * *